US009259768B2

(12) United States Patent
Aguerre et al.

(10) Patent No.: US 9,259,768 B2
(45) Date of Patent: Feb. 16, 2016

(54) LAMINAR AIR FLOW CABINET

(71) Applicant: KIRO ROBOTICS, S.L., Aretxabaleta (Gipuzkoa) (ES)

(72) Inventors: Jean-Philippe Aguerre, Itxassou (FR); Borja Lizari Illarramendi, Vitoria-Gasteiz (ES); Naiara Telleria Garay, Arrasate-Mondragon (ES); Gerardo Cajaraville Ordonana, Donostia (ES); Maria Jose Tames Alonso, Donostia (ES); Jose Maria Aragones Rebollo, Aretxabaleta (ES)

(73) Assignee: Kiro Robotics, S.L., Gipuzkoa (ES)

( * ) Notice: Subject to any disclaimer, the term of this patent is extended or adjusted under 35 U.S.C. 154(b) by 237 days.

(21) Appl. No.: 13/918,557

(22) Filed: Jun. 14, 2013

(65) Prior Publication Data

US 2014/0166123 A1 Jun. 19, 2014

(30) Foreign Application Priority Data

Dec. 14, 2012 (ES) ..... 201231947

(51) Int. Cl.

| | |
|---|---|
| ***B08B 9/00*** | (2006.01) |
| ***B08B 9/08*** | (2006.01) |
| ***B08B 15/00*** | (2006.01) |
| ***B08B 15/02*** | (2006.01) |
| ***B01L 1/04*** | (2006.01) |
| ***F24F 3/16*** | (2006.01) |

(52) U.S. Cl.

CPC ... *B08B 9/08* (2013.01); *B01L 1/04* (2013.01); *B08B 9/00* (2013.01); *B08B 15/00* (2013.01); *B08B 15/023* (2013.01); *F24F 3/1607* (2013.01); *B08B 2215/003* (2013.01); *B08B 2215/006* (2013.01); *Y10T 137/4238* (2015.04)

(58) Field of Classification Search

CPC . F24F 3/1607; B08B 2215/003; B08B 15/02; Y10S 55/18

USPC ..... 137/487.5, 574, 586; 55/385.2, DIG. 18, 55/473, DIG. 29, DIG. 36; 454/187, 56, 57, 454/62; 134/111, 57 R, 104.2, 108

See application file for complete search history.

(56) References Cited

U.S. PATENT DOCUMENTS

| | | | |
|---|---|---|---|
| 2,702,505 | A | 2/1955 | Nelson |
| 3,944,405 | A | 3/1976 | Van Calsteren et al. |

(Continued)

FOREIGN PATENT DOCUMENTS

| | | | |
|---|---|---|---|
| EP | 1464413 | A2 | 10/2004 |
| EP | 2457550 | A1 | 5/2012 |
| GB | 1178118 | | 1/1970 |

OTHER PUBLICATIONS

International Search Report dated Dec. 14, 2012 in corresponding Spanish application No. ES 201231947.

*Primary Examiner* — Michael Barr
*Assistant Examiner* — Thomas Bucci
(74) *Attorney, Agent, or Firm* — RatnerPrestia

(57) ABSTRACT

A laminar air flow cabinet of the type comprising a laminar flow portion and two adjacent portions, a first adjacent portion located above the laminar portion and a second adjacent portion located below the laminar flow portion, in which the cabinet comprises at least one fan blowing air from the first of these adjacent portions to the laminar flow portion through a first filter, and a second filter located in the second of the adjacent portions, the cabinet comprising at least one spray located in the laminar flow portion, a hydraulic pump injecting fluid through the spray and at least one impermeable surface located between the second filter and the laminar flow portion.

10 Claims, 4 Drawing Sheets

(56) References Cited

U.S. PATENT DOCUMENTS 5,433,380 A * 7/1995 Hahn ..... A01M 7/0085
134/169 R
6,370,972 B1 4/2002 Bomber et al.
2003/0222087 A1* 12/2003 Frickel ..... B08B 15/023
220/571
2013/0061567 A1* 3/2013 Kawasaki ..... B01L 1/04
55/385.2

* cited by examiner

LAMINAR AIR FLOW CABINET

BACKGROUND

This invention relates to a laminar air flow cabinet comprising an associated cleaning mechanism. In particular this invention relates to a laminar air flow cabinet and a cleaning mechanism through pushing off for removing chemical residues which may be located within the cabinet, for example after the preparation of medications.

There are various mechanisms for cleaning laminar flow cabinets such as ultraviolet cleaning mechanisms which remove bacteria through the use of UV rays, but these cleaning mechanisms function as antibacterial agents and are inefficient for the chemical and/or microbiological cleaning of laminar flow cabinets.

There are also physical cleaning systems that are added to cabinets in the pharmaceutical industry. These cabinets are common systems which can be fitted to the cabinets and add openings for the expulsion of pressurised fluid and drains. In these systems a cleaning cycle is performed in which pressurised water is expelled through the openings, the pH of the water leaving through the drains is measured, and once the measured pH is neutral the cleaning process is stopped. These cleaning mechanisms can have an adverse effect on parts of the cabinets because they do not take the layout of delicate components into account.

For example laminar flow cabinets in pharmaceutical applications include HEPA (from the English expression "High Efficiency Particulate Air"), ULPA (from the English expression "Ultra-Low Penetration Air") or activated carbon filters. These filters have the common feature that they are very delicate and deteriorate appreciably when in contact with liquids.

As indicated previously, the physical cleaning systems in the prior art involve large quantities of water at high pressures which in the case of pharmaceutical applications are not very convenient because they can wet the air filters because of splashing and/or inadequate drainage systems.

In order to overcome the abovementioned problems this invention provides for a laminar air flow cabinet having an associated cleaning system which ensures that the filters remain intact and brings about suitable physical cleaning of each of the components in the system.

SUMMARY

Specifically this invention provides a laminar air flow cabinet of the type comprising a laminar air flow portion and adjacent portions, a first adjacent portion located above the laminar flow portion and a second adjacent portion located below the laminar flow portion, in which the cabinet comprises:

at least one fan driving air from the first of the adjacent portions mentioned through an upper filter to the laminar flow portion, and a lower filter located in the second of the aforementioned adjacent portions; the first adjacent portion being connected to the second adjacent portion through an air recycling duct, the cabinet also comprising:

at least one spray located in the laminar flow portion;

a hydraulic pump which injects fluid through the spray; and at least one impermeable surface located between the lower filter and the laminar flow portion;

in which the impermeable surface has a gradient which directs the cleaning fluid to a drain, a second air duct connecting the second adjacent portion to the air recycling duct via the lower filter being located beneath the impermeable surface.

In this invention, when the presence of a laminar flow is mentioned this refers to a laminar flow of air.

Also when it is stated that the impermeable surface has at least one gradient this means that there is a difference in height between at least two points on the surface which enables the cleaning fluid falling onto the surface to be directed to a drain.

In preferred embodiments of this invention the filters may be HEPA, ULPA, or activated carbon filters, etc., among others. Even more preferably, various filters of different types are located in the cabinet.

In a particular embodiment the surface with a gradient has a central section which defines the highest point on the surface and two lateral sections which define the lowest points on the surface. That is to say the surface may have an inverted "V", conical or pyramidal shape, among others.

In order to ensure better laminar flow and to ensure that the cleaning fluid originating from the sprays falls into specific regions, a perforated tray, through the perforations of which both the laminar air flow and the cleaning fluid expelled by the sprays pass, is located between the impermeable surface and the laminar flow portion.

In particular the plate has a perforated region and a region which is free of perforations, the perforated region preferably being a region in the vicinity of the perimeter of the tray. In this way it is possible to have at least one air duct beneath the part of the plate free of perforations into which no water falls because the plate functions as a roof and through which the air travelling to the second filter can pass.

Additionally an embodiment of the cabinet according to this invention incorporates a flow measurement system and a flow control system connected to both the flow measurement system and the pump in order to maintain a substantially constant injection flow of cleaning liquid to the spray. This fluid injected into the spray may comprise water and/or at least one cleaning agent, such as for example a detergent.

Preferably at least one of the sprays comprises a full-cone nozzle. In addition to this at least one of the sprays may be connected to the cabinet through articulated junction means which enable the nozzle to be moved to adjust where it is desired that the fluid should be expelled.

For a better understanding, drawings of an embodiment of the cleaning system to which this invention relates are appended by way of an explanatory but not limiting example.

DESCRIPTION

Figure 1:
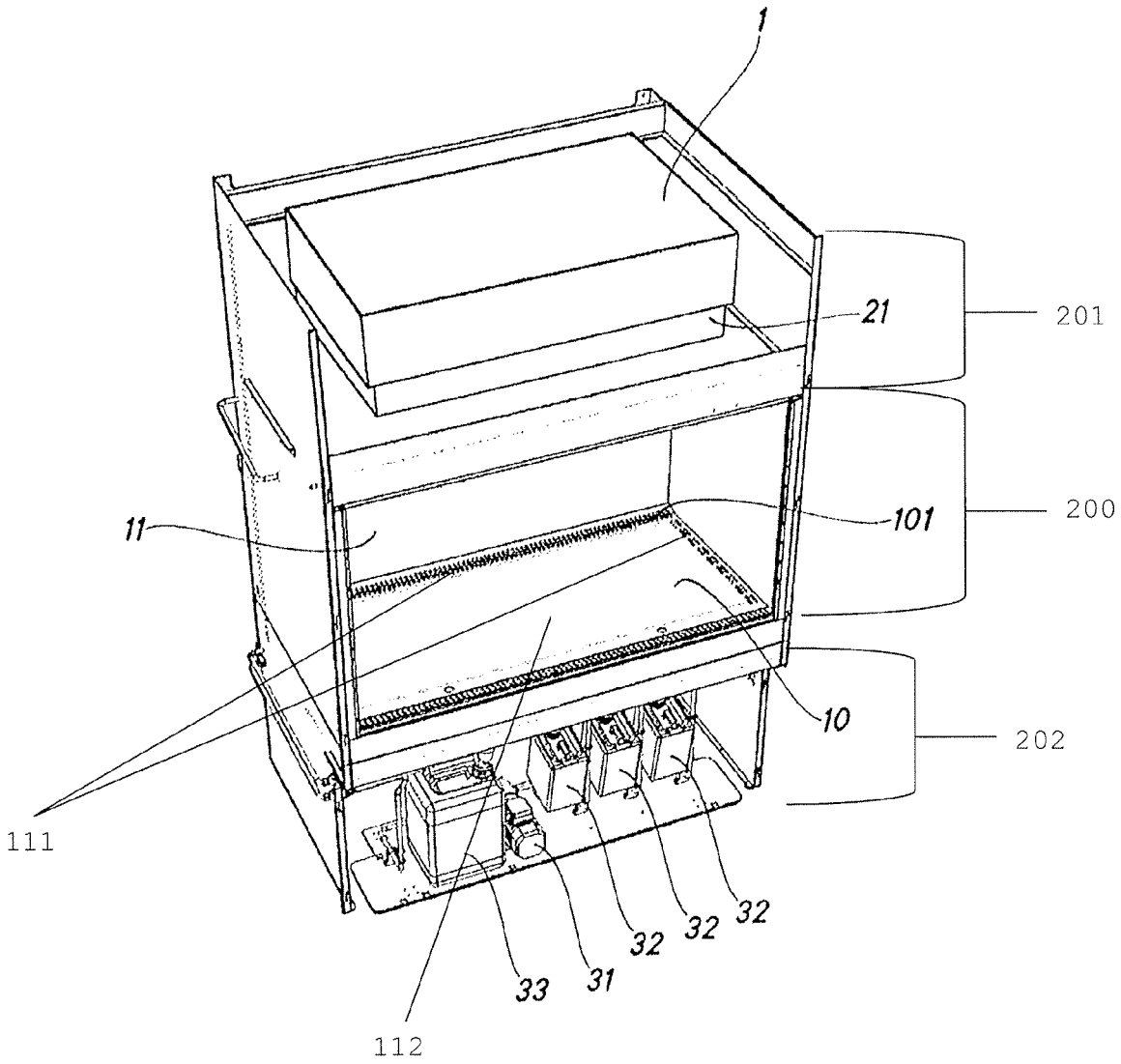
FIG. 1 shows a perspective view of a cabinet according to this invention.

FIG. 1 shows a laminar air flow cabinet comprising a first adjacent portion -201-, an air impulsion system -1-, an upper filter -21-, a laminar flow portion -200- between the upper filter -21- and tray -10-, a second adjacent portion -202- comprising a liquids collection portion (not shown) and at least one lower filter (not shown) beneath plate or tray -10-.

The laminar flow cabinet comprises a cleaning system using fluid comprising at least one tank -32- for the storage of fluids, a pump -31- to expel the fluids under pressure and a wastes collection tank -33-.

This cleaning system comprises means for expelling fluid into the laminar flow portion to effect mechanical cleaning through flushing off possible chemical products which may have been spilled as a consequence of the preparation of medications. The expelled fluid may be water and/or any combination of detergent fluids to bring about cleaning and/or microbiological cleaning in addition to mechanical flushing.

Given that the filters used are preferably HEPA, ULPA or activated carbon filters or any combination of these, it is appropriate that these filters should not come into contact with liquids as this may be prejudicial to their operation, in addition to reducing their service lives. As a consequence an appropriate drainage system must be provided and this will be described in greater detail with reference to FIG. 2.

In FIG. 1 however it will be seen that tray -10- has perforations -101- along its periphery, such that the tray comprises a perforated region -111- and a region free of perforations -112-, so that the liquids will only pass from the laminar flow portion to the region in which the lower filters are located via the peripheral portion of the cabinet where the filters are not located, these being located in regions which are free of perforations.

In other particular embodiments the perforations are not located on the periphery but follow other layout patterns although the principle of distinguishing perforation-free region beneath which the lower filters are located is retained.

In addition to this the cabinet illustrated in FIG. 1 comprises an air recycling system so that the air which passes through the lower filter (not shown) passes behind panel -11- of the laminar flow portion and part of this air passes through the air impulsion system through upper filter -21-.

Figure 2:
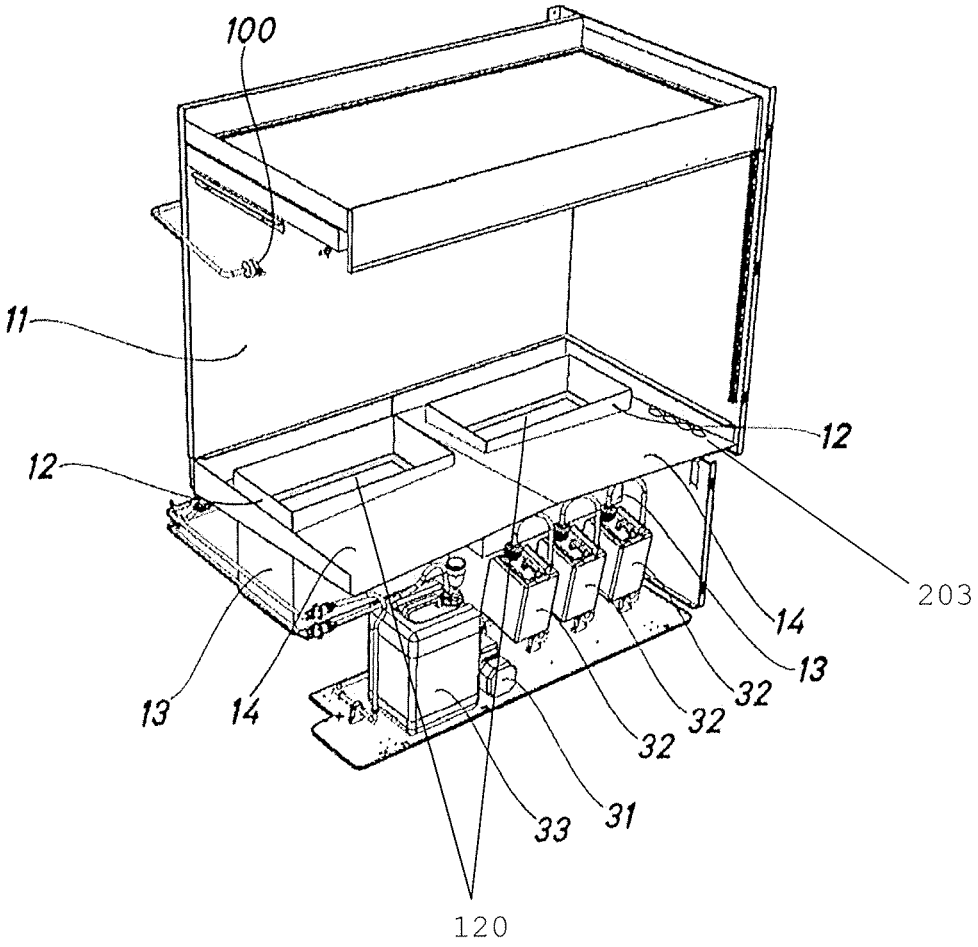
FIG. 2 shows a perspective view of the internal components of the cabinet in FIG. 1.

FIG. 2 shows a perspective view of the cabinet in FIG. 1 without tray -10- and one of the side panels.

FIG. 2 shows details of the components located beneath tray -10-. In particular it will be seen that one embodiment of this invention comprises two lower filters -13- and that an impermeable surface -14- which has a dual drainage mechanism with gradients whose lowest points are located substantially at the sides of the cabinet is located beneath tray -10-. In the vicinity of the lowest parts of these gradients there are drains -203- through which the cleaning fluid passes and is subsequently collected in a wastes collection tank -33-. Preferably the fluid collected is transferred to waste collection tank -33- through the action of gravity.

Furthermore it will be seen that in order to facilitate the flow of air to the filters the impermeable surface incorporates two openings -120-. These openings have a projecting portion -12- substantially transverse to the plate to prevent liquids passing through them as a result of the splashing which may occur as a consequence of the free fall of liquid through tray -10- onto impermeable surface -14-.

Additionally, this embodiment by way of example incorporates three tanks -32- (although there may be a single tank) each connected to a pneumatically operated pharmaceutical grade membrane valve having a maximum flow of 3.5 $m^3$/h. This valve opens for a specific time to allow cleaning fluid to pass from the tanks through the action of a sanitary grade electrically-driven hydraulic pump which preferably operates at 1800 rpm with a range of flows up to 1.4 $m^3$/h and is capable of injecting the cleaning fluid into the circuit with the necessary pressure to maintain a constant flow during spraying (avoiding pulses and the drip effect, which affect the functioning of the spray).

In addition to this one of tanks -32- may be connected to a disinfecting detergent metering device. Instead of demineralised and/or sterile water tanks -32- (to avoid lime staining and/or contamination of materials in the working area), water for sanitary purposes and internal water purification equipment may be used.

Figure 3:
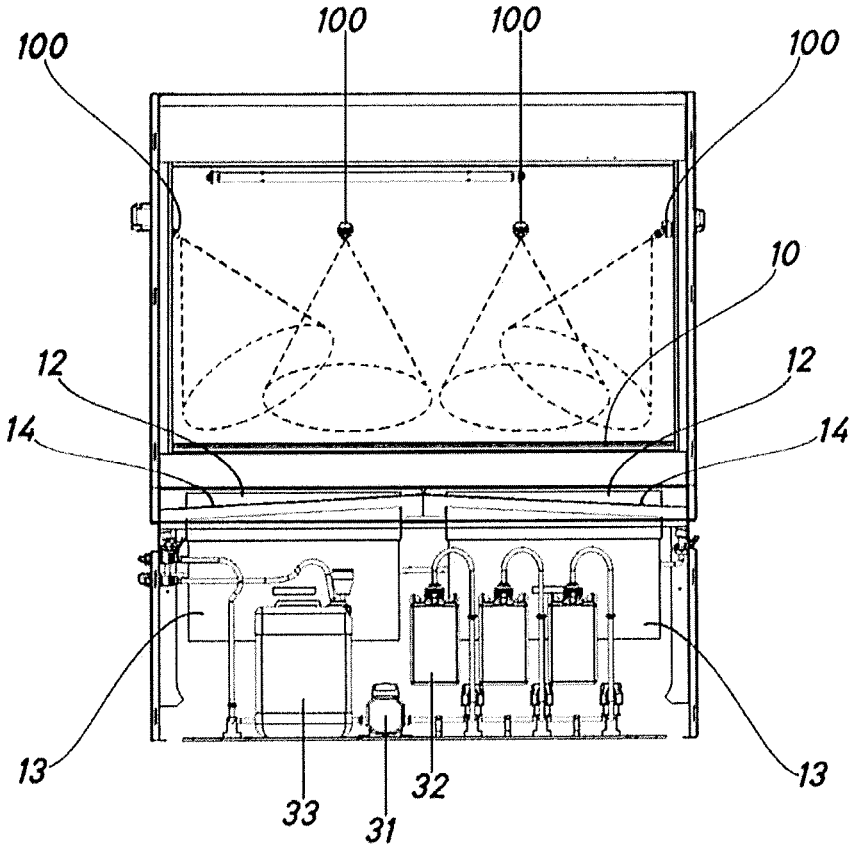
FIG. 3 shows a front view of the cabinet in FIG. 1.

FIG. 3 shows a front view of the cabinet in FIG. 1. This figure provides a more detailed illustration of the layout of sprays -100- which are responsible for expelling the fluids present in tank -32- to clean the cabinet.

Sprays -100- comprise spray nozzles, and these spray nozzles are preferably full-cone nozzles (as shown in the figure) and have an outlet diameter of 1.6 mm with flows of between 1 and 3 liters per minute.

The nozzles are fitted on a universal joint which can keep the nozzle as close as possible to the wall of the laminar flow portion and change the angle of rotation to configure an appropriate cleaning spray for the portions with the greatest risk of contamination. These universal joints also restrict the angle of rotation upward (so that the nozzles do not direct the spray upwards where the upper filters are located).

Four sprays -100- are used in this embodiment to reach the most critical regions of the laminar flow portion, minimising cleaning dead spaces, but it must be borne in mind that the number of sprays -100- is variable, depending upon the size and/or shape of the surface being cleaned. The flushing effect is brought about through the fall of water down surfaces of minimum roughness, in sufficient volume and in liquid form. The purpose of the cleaning system is not to provide a cleaning jet, but a cone of small droplets of liquid which cover all the surfaces and flow down them through the effect of gravity.

As far as the drying mechanism of the cabinet is concerned, the same laminar air flow system is responsible for carrying out this task. In fact the cabinet can also be dried even though the flow of air is not laminar, the only requirement for drying being that there should be movement of the air and some renewal of the quantity of air passing through the wetted portion. As a consequence the same laminar air flow system can be used as a drying mechanism, or a mechanism which blows in a flow of turbulent air can be incorporated.

In the embodiments illustrated the working air velocities are between 0.19 m/s and 0.45 m/s, giving rise to flows between 700 $m^3$/h and 1400 $m^3$/h over a surface of approximately 1 $m^3$. The proportion of air recycled to the laminar flow portion is between 60% and 80% when the front window is open (open by some 250 mm) and between 85% and 100% when it is closed.

Figure 4:
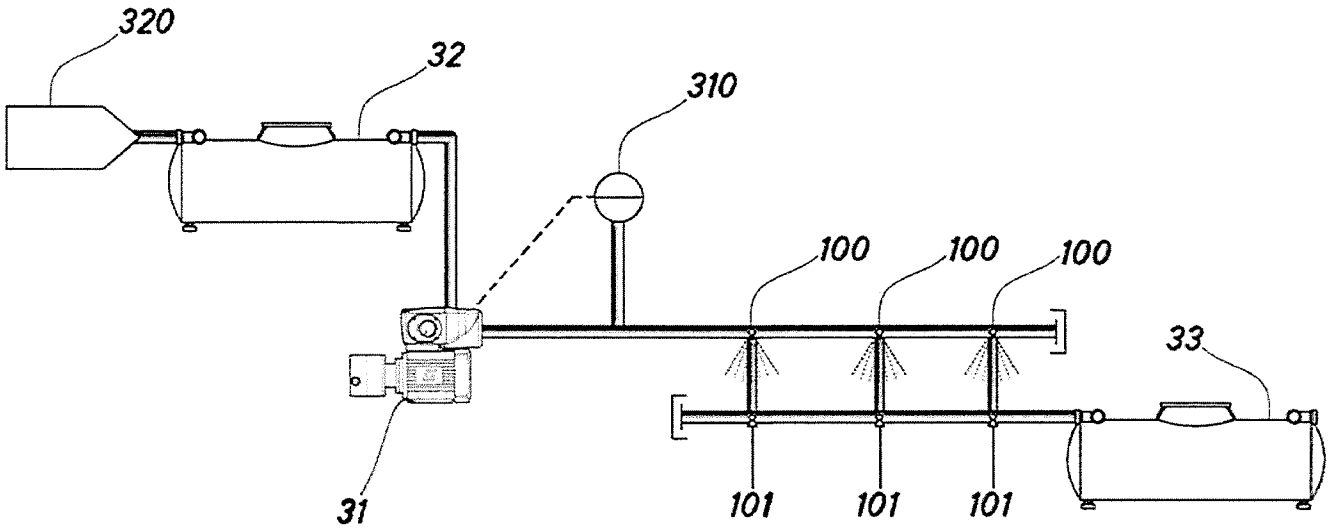
FIG. 4 shows a diagram of an embodiment of a water circuit in a cabinet according to this invention.

FIG. 4 shows an embodiment of a water circuit in the cleaning system for the cabinet in FIGS. 1 and 3.

In this circuit it will be seen that fluid storage tank -32- can be connected to a fluid supply system -320- in order to refill it when it reaches a previously determined minimum level.

The outflow from this tank -32- is connected to a pump -31- which may be operated manually or automatically. Hydraulic and/or electric means may be included among the automatic means for driving pump -31-.

It is especially to be recommended that pump -31- should have a constant outlet flow, as a consequence an outlet flow measuring and/or controlling device -310- is incorporated so that a constant flow is guaranteed enabling sprays -100- to have a constant flow, and drips or spraying with a spraying angle smaller than that initially calculated are avoided.

The output from sprays -100- is collected through a drainage system -101- described above to remove waste fluid to a waste storage tank -33-.

Although the invention has been described in relation to preferred embodiments, these must not be regarded as limiting the invention, which will be defined by the broadest interpretation of the following claims.

The invention claimed is:

1. A laminar air flow cabinet comprising:

(a) a first adjacent portion;

(b) a laminar flow portion, located below the first adjacent portion, comprising at least one spray nozzle;

(c) a second adjacent portion, located below the laminar flow portion, comprising (i) at least one lower filter, (ii) at least one waste collection tank, (iii) at least one fluid storage tank, and (iv) at least one hydraulic pump which injects a fluid from the at least one fluid storage tank to the at least one spray nozzle which sprays the fluid;

(d) at least one fan which drives air from the first adjacent portion to the laminar flow portion through at least one upper filter;

(e) a tray located between the laminar flow portion and the second adjacent portion, comprising (i) a perforated region having perforations through which the air from the laminar flow portion and the fluid from the spray nozzle pass, wherein the perforations are in the vicinity of the perimeter of the tray, and (ii) a region free of perforations; and (f) an impermeable surface located beneath the tray and between the laminar flow portion and the lower filter, the impermeable surface comprising:

(i) at least one opening, through which the air through the perforations passes, the opening comprising a projecting portion transverse to the tray that prevents the fluid through the perforations from passing through the opening, and (ii) a gradient which directs the fluid through the perforations to at least one drain and to be collected in the at least one waste collection tank.

2. The cabinet according to claim 1, wherein at least one of the filters is a HEPA filter.

3. The cabinet according to claim 1, wherein at least one of the filters is an ULPA filter.

4. The cabinet according to claim 1, wherein at least one of the filters is an activated carbon filter.

5. The cabinet according to claim 1, wherein the impermeable surface has a central section defining the highest point of the impermeable surface and two lateral sections which define lower points on the impermeable surface.

6. The cabinet according to claim 1, which further comprises a flow measurement system and a flow control system connected to the flow measurement system and the pump to maintain a substantially constant injection flow rate of the fluid to the spray nozzle.

7. The cabinet according to claim 1, wherein the at least one spray nozzle comprises a full-cone nozzle.

8. The cabinet according to claim 1, wherein the at least one spray nozzle is connected to the cabinet by one or more articulated joints.

9. The cabinet according to claim 1, wherein the fluid injected into the at least one spray nozzle comprises water.

10. The cabinet according to claim 1, wherein the fluid injected into the at least one spray nozzle comprises at least one cleaning agent.

* * * * *